US006803102B1

(12) United States Patent
Talley et al.

(10) Patent No.: US 6,803,102 B1
(45) Date of Patent: Oct. 12, 2004

(54) SPINNERET HOLE CONFIGURATION FOR PREVENTING BENDING OF BICOMPONENT EXTRUDATE

(75) Inventors: Arthur Talley, Melbourne, FL (US); Arnold E. Wilkie, Merritt Island, FL (US); Jeffrey S. Haggard, Cocoa, FL (US)

(73) Assignee: Hills, Inc., West Melbourne, FL (US)

( * ) Notice: Subject to any disclaimer, the term of this patent is extended or adjusted under 35 U.S.C. 154(b) by 0 days.

(21) Appl. No.: 09/959,999

(22) PCT Filed: May 15, 2000

(86) PCT No.: PCT/US00/13167

§ 371 (c)(1),
(2), (4) Date: Apr. 17, 2002

(87) PCT Pub. No.: WO00/70131

PCT Pub. Date: Nov. 23, 2000

Related U.S. Application Data

(60) Provisional application No. 60/134,263, filed on May 14, 1999.

(51) Int. Cl.[7] ..... D01F 8/00

(52) U.S. Cl. ..... 428/373; 428/374; 428/370

(58) Field of Search ..... 428/373, 374

(56) References Cited

U.S. PATENT DOCUMENTS

| | | | | |
|---|---|---|---|---|
| 3,718,534 A | * | 2/1973 | Okamoto et al. | 428/374 |
| 5,093,061 A | | 3/1992 | Bromley et al. | 264/171 |
| 5,162,074 A | | 11/1992 | Hills | 264/211.14 |

* cited by examiner

*Primary Examiner*—N. Edwards
(74) *Attorney, Agent, or Firm*—Edell, Shapiro & Finnnan, LLC

(57) ABSTRACT

A spinneret (140) for extruding side-by-side bicomponent fibers includes a spinneret hole (148) having a cross-sectional shape transverse to the direction of polymer flow that is asymmetric with respect to the arrangement of the side-by-side streams of polymer components therein. The lower viscosity component flows through a portion of the spinneret hole having a higher perimeter-to-area cross-sectional shape than the portion of the spinneret hole through which the higher viscosity component through which the lower viscosity component flows. The increased surface area (i.e., cross-sectional perimeter) of the spinneret hole contacting the lower viscosity polymer flow compensates for the viscosity differential between the polymer components that would otherwise result in dogleg bending of the extrudate.

9 Claims, 2 Drawing Sheets

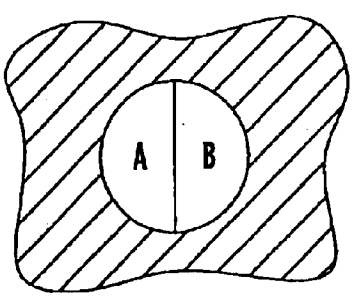
FIG.2
PRIOR ART
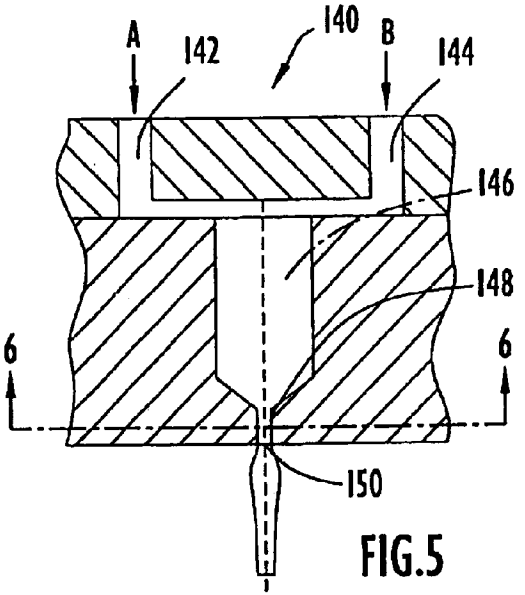
FIG.1
PRIOR ART
FIG.5
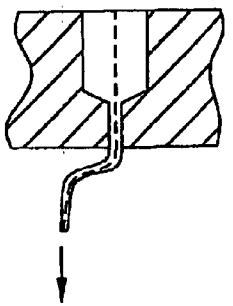
FIG.3
PRIOR ART
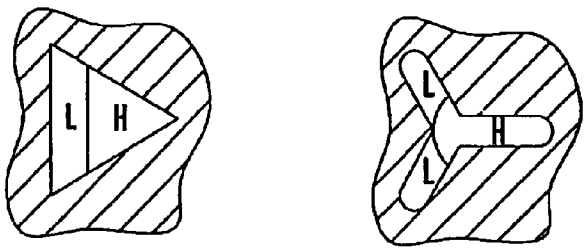
FIG.6
FIG.7
FIG.8
FIG.9
FIG.10

SPINNERET HOLE CONFIGURATION FOR PREVENTING BENDING OF BICOMPONENT EXTRUDATE

CROSS REFERENCE TO RELATED APPLICATION

This application claims priority from U.S. Provisional Patent Application Ser. No. 60/134,263, entitled "Spinneret Hole Configuration for Preventing Bending of Bi-Component Extrudate At Orifice," filed May 14, 1999. The disclosure of this provisional patent application is incorporated herein by reference in its entirety.

BACKGROUND OF THE INVENTION

1. Field of the Invention

The present invention relates to methods and apparatus for extruding bicomponent, side-by-side polymer fibers whose components have significantly different viscosities and, more particularly, to spinneret hole configurations and arrangements of components therein that prevent bending of side-by-side components of different viscosities upon extrusion.

2. Description of the Related Art

Woven and non-woven fabrics and yarns having desirable qualities can be manufactured from crimped side-by-side, bicomponent synthetic polymer fibers. Such bicomponent fibers typically include two different polymers arranged as microfilaments or segments across the transverse cross section of the fiber, which segments extend continuously along the length of the fiber. A melt spinning process involving extrusion of the molten polymer from orifices of a spinneret can be used to form these side-by-side bicomponent fibers. By causing one or both of the constituent segments to crimp after extrusion, a fine denier fabric or yarn can be produced with improved characteristics, such as greater bulkiness and softness, superior flexibility and drape, and better barrier and filtration properties for use in products such as disposable absorbent articles, medical garments, filtration materials, apparel, and carpet.

As is well known in the art, a side-by-side bicomponent or biconstituent fiber, in which the polymer components have significantly different thermal shrinkage characteristics, will form helical crimps when the fiber is subjected to heat, as described in U.S. Pat. No. 5,093,061 to Bromley et al., the disclosure of which is incorporated herein by reference in its entirety. A yarn made of side-by-side conjugate filaments will also develop crimps if the yarn is stretched slightly and then allowed to relax. A high degree of crimping of the bicomponent fibers is desirable, since a lofty or bulky non-woven fabric having good softness, flexibility and drape characteristics and barrier properties results.

Side-by-side bicomponent fibers can also be useful where one of the components is used as an adhesive to bond the fibers into a web. In this case, one component typically has a significantly lower melting temperature than the other component and, upon heating to the softening point, permits adjacent fibers to be bonded to each other without melting the other component.

At present, common methods of producing side-by-side conjugate fibers employ an arrangement that introduces two separated polymer streams, A and B, into the spinneret orifice through narrow channels from opposite directions above a spin hole. FIG. 1 illustrates a conventional spinneret 10 having one channel 12 that directs a stream of polymer A downstream and another channel 14 that directs a separate stream of polymer B downstream. Channels 12 and 14 respectively deliver polymers A and B to the upstream end of a cylindrical counterbore 16 that tapers at its downstream end to a spinneret hole 18 forming an orifice 20 at the bottom face of spinneret 10. The spinneret hole 18 has a round cross-section transverse to the flow direction, as shown in FIG. 2. The polymers form a side-by-side flow inside the spinneret hole 18 as well as through the orifice 20, with each component occupying a substantially. semi-circular transverse area within the spinneret hole. The fiber thus produced has a substantially round, side-by-side transverse cross section.

In prior art fiber melt spinning systems, the viscosities of the two side-by-side polymer components, which are a function of temperature, must be matched. If the viscosities of two polymer components are different, the higher viscosity polymer component flowing through the spinneret orifice loses more momentum than is lost by the low viscosity component This loss of momentum is due primarily to friction between the polymer and the spinneret hole wall. Consequently, at the exit orifice, the low viscosity polymer component pushes the high viscosity component transversely and causes the combined polymer extrudate to bend or deflect in the direction of the high viscosity polymer component. This bending phenomenon, shown in FIG. 3, is commonly referred to as extrudate dogleg. Extrudate with a high degree of dogleg can flow along and contact the spinneret bottom surface, causing the combined polymer components to become, in effect, un-spinnable. Therefore, matching the viscosities of two polymers at the spin pack orifices has been heretofore essential, limiting the permissible viscosity differences and, thereby, the crimp that is obtained in the bicomponent fiber. It has been observed that drawn fibers formed from certain polymers with greater viscosity differences exhibit a high degree of crimping. Thus, many desirable fibers formed of highly-crimpable polymer combinations may often be un-spinnable.

When the viscosities of the two polymers are equal at the spinning orifice, the polymer extrudate is straight and perpendicular to the downstream spinneret surface; i.e., there is no bending or dogleg. When the viscosities of the two polymers are different, the degree of bending or dogleg is determined by: the viscosity difference; the spinneret hole length (or, the ratio of spinneret hole length to spinneret hole diameter, L/D); the polymer flow rate through the orifice; and the volume flow rate ratio between the two polymers. Bending of the extrudate increases with the increase of the viscosity difference, the orifice length and the polymer flow rate; bending can be increased or decreased by varying the polymer flow rate ratio.

It is difficult to find pairs of polymers that yield the desired final spun product and also have matched viscosities for a specified range of spinning temperatures. For example, desirable polymers for forming side-by-side bicomponent fibers may include polyester (polyethylene terepthalate or PET) and polybutylene terepthalate (or PBT). Due to limited availability of commercial grades of these two polymers and other reasons (e.g., economical reasons), one must necessarily choose a PET and a PBT with slightly mismatched viscosities. Consequently, only a limited number of commercially available polymers have been usable to form crimpable side-by-side bicomponent fibers that yield fabrics and yams having the aforementioned highly desirable qualities. Accordingly, there remains a need for methods and apparatus capable of melt spinning side-by-side bicomponent fibers whose components have significantly different viscosities.

SUMMARY OF THE INVENTION

Therefore, in light of the above, and for other reasons that become apparent when the invention is fully described, an object of the present invention is to provide processes and apparatus capable of compensating for viscosity differences between melt-spinnable polymers in order to prevent excessive bending of such polymers when extruded side-by-side from orifices of a spinneret.

Another object of the present invention is to increase the number of polymer combinations available for forming side-by-side bicomponent fibers by expanding the acceptable range of polymer viscosity mismatches that will yield melt-spinnable fibers without excessive extrudate bending.

Yet another object of the present invention is to produce highly crimpable side-by-side bicomponent fibers from pairs of polymers having substantially mismatched viscosities.

Still another object of the present invention is to provide asymmetric cross-sectional geometries of side-by-side polymer streams within a spinneret hole that compensate for polymer viscosity differences, thereby preventing extrudate dogleg bending.

It is another object of the present invention to produce yarns, fabrics and textile products having improved characteristics from side-by-side bicomponent fibers whose components have mismatched viscosities.

The aforesaid objects are achieved individually and in combination, and it is not intended that the present invention be construed as requiring two or more of the objects to be combined unless expressly required by the claims attached hereto.

In accordance with the present invention, the aforementioned difficulties associated with extruding side-by-side polymers to form bicomponent fibers are overcome by employing a spinneret hole configuration that is asymmetric with respect to the arrangement of the component polymer streams flowing through and extruded from the spinneret hole. In particular, the components are arranged within the spinneret hole such that the ratio of the perimeter of the spinneret hole bounding the cross-sectional flow area of the lower viscosity component to the cross-sectional flow area of the lower viscosity component is greater than the corresponding ratio for the higher viscosity component. In other words, polymer viscosity differences that normally lead to dog-legging can be reduced or eliminated by arranging the polymer streams to increase the relative amount of surface area of the spinneret hole that contacts the lower viscosity component.

The transverse cross section shape of the spinneret hole and the resulting conjugate fiber may be trilobal, triangular, teardrop, bulb-and-stem or any other configuration that permits the lower viscosity component to occupy a portion of the transverse cross-section having a greater perimeter-to-area ratio and hence permits the higher viscosity component to occupy a portion of the transverse cross-section having a lesser perimeter-to-area ratio. The spinneret hole geometries and the associated asymmetric polymer component arrangements of the present invention advantageously allow heretofore un-spinnable combinations of polymers with mismatched viscosities to be successfully melt spun into crimpable side-by-side bicomponent fibers that can be formed into yarns and fabrics with superior characteristics, such as greater bulkiness and softness, superior flexibility and drape, and better barrier and filtration properties for use in products such as disposable absorbent articles, medical garments, filtration materials, apparel, and carpet.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

BRIEF DESCRIPTION OF THE DRAWINGS

FIG. 1 is a cross-sectional side view in elevation of a spinneret hole of a conventional spinneret for producing a side-by-side bicomponent synthetic polymer fiber.

FIG. 2 is a transverse cross-sectional view of the spinneret hole shown in FIG. 1.

FIG. 3 is a cross-sectional side view in elevation of a portion of a conventional spinneret illustrating the polymer bending or "dog-legging" phenomenon that occurs when the viscosities of the two polymer components differ significantly.

FIG. 5 is a cross-sectional side view in elevation of a spinneret hole of a spinneret for producing a side-by-side bicomponent synthetic polymer fiber in accordance with an exemplary embodiment of the present invention.

FIG. 6 is a transverse cross-sectional view illustrating the distribution of the higher and lower viscosity polymer components flowing through a spinneret hole having a substantially triangular transverse cross-sectional shape in accordance with one embodiment of the present invention.

FIG. 7 is a transverse cross-sectional view illustrating the distribution of the higher and lower viscosity polymer components flowing through a spinneret hole having a trilobal transverse cross-sectional shape in accordance with another embodiment of the present invention.

FIG. 8 is a transverse cross-sectional view illustrating the distribution of the higher and lower viscosity polymer components flowing through a spinneret hole having a teardrop transverse cross-sectional shape in accordance with another embodiment of the present invention.

FIG. 9 is a transverse cross-sectional view illustrating the distribution of the higher and lower viscosity polymer components flowing through a spinneret bole having a transverse cross-section in the shape of a "U" with an undulating side wall corresponding to the top of the "U", in accordance with another embodiment of the present invention.

FIG. 10 is a transverse cross-sectional view illustrating the distribution of the higher and lower viscosity polymer components flowing through a spinneret hole having a keyhole-shaped transverse cross-section in accordance with another embodiment of the present invention.

DESCRIPTION OF THE PREFERRED EMBODIMENTS

Figure 4:
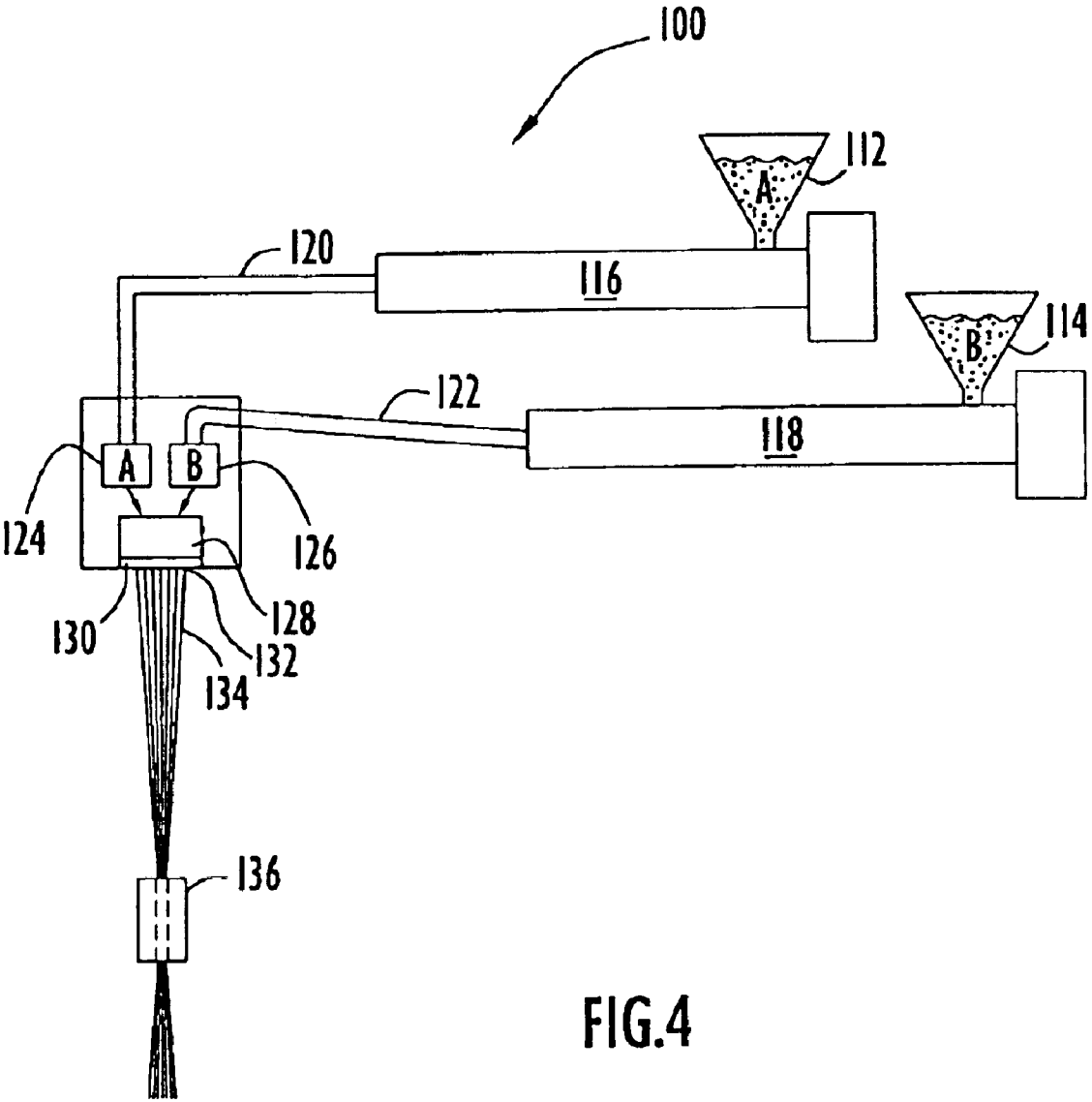
FIG. 4 is a diagrammatic side view in elevation of an assembly for extruding side-by-side bicomponent fibers in accordance with an exemplary embodiment of the present invention.

The following detailed explanations of FIGS. 4–10 and of the preferred embodiments reveal the methods and apparatus of the present invention. According to the present invention, two polymers with mismatched viscosities, which could not be spun into side-by-side bicomponent fibers via a spinneret with conventional, round spinning orifices, can be spun into side-by-side fibers with spinning orifices configured to have a larger perimeter for the flow region of the lower viscosity component than for the flow region of the higher viscosity component. The present inventors have found that the flow speeds of the two polymer components can be substantially equalized (thereby avoiding extrudate bending) by increasing the proportion of the transverse cross-section perimeter of the spinneret hole that contacts the lower viscosity component and decreasing the proportion of the spinneret hole perimeter that contacts the higher viscosity component. Accordingly, the present invention pertains to spinneret hole cross-sections that permit spinning of side-by-side fiber segments of different viscosities. As described in greater detail hereinbelow, a variety of different spinneret hole cross-sectional configurations and component distributions produce acceptable cross-sections for textile fibers from pairs of polymer having significantly different viscosities.

The present invention will generally be described in terms of methods and apparatus that produce side-by-side bicomponent fibers having only two segments or sub-fibers, one of each component. However, it should be understood that the scope of the present invention is meant to include any fibers with two or more components or with two or more segments or sub-fibers where bending or dog-legging of the extrudate occurs with substantial polymer viscosity differences. For example, significant dog-legging would not normally be expected to occur with a bicomponent fiber having a transverse cross-section with four or more alternating "pie-shaped" wedges of the two components or with ribbon-shaped fiber having alternating higher and lower viscosity components. On the other hand, a three component fiber having two lower viscosity components and one higher viscosity component could potentially experience unacceptable extrudate bending, depending on the cross-sectional arrangement of the components; thus, the principles of the present invention can be extended to methods and apparatus for producing fibers having more than two segments and/or more than two components in appropriate configurations.

As used herein the term "extrudate" refers to the molten or semi-molten polymer streams that flow out of the orifices of a spinneret which, upon quenching and further processing (e.g., drawing) become fibers. The term "fiber" as used herein includes both fibers of finite length, such as conventional staple fiber, as well as substantially continuous structures, such as filaments, unless otherwise indicated. The terms "segment" and "sub-fiber" refer to a portion of a fiber having a composition that is distinct from the composition of another portion of the fiber, and the term "bicomponent" refers to a fiber having at least two segments, wherein at least one of the segments comprises one material or component (e.g., a polymer), and the remaining segments comprise another, different material or component.

As used herein, the term "side-by-side" refers to an arrangement wherein the transverse cross-section of the extrudate and subsequently formed fiber includes a first region formed of one component and a second, distinct region formed of another component, wherein the perimeter of the fiber cross-section is formed in part by an edge of the first region and in part by an edge of the second region (e.g., side-by-side would not include sheath-core arrangements). Typically, the fiber components are arranged so as to form distinct unocclusive cross-sectional segments or sub-fibers that retain their transverse cross-section shapes throughout the length of the fiber.

Referring to FIG. 4, an assembly 100 for extruding side-by-side bicomponent fibers in accordance with an exemplary embodiment of the present invention is shown. Apparatus 100 includes hoppers 112 and 114 into which pellets of two different polymers, polymers A and B, are respectively placed. Polymers A and B are respectively fed from hoppers 112 and 114 to screw extruders 116 and 118 that melt the polymers. The molten polymers respectively flow through heated pipes 120 and 122 to metering pumps 124 and 126, which in turn feed the two polymer streams to a suitable spin pack 128 with internal parts for forming side-by-side bicomponent fibers of a chosen cross-section.

Spin pack 128 includes a final polymer filtration system, distribution systems and a spinneret 130 with an array of spinning orifices 132 which shape the bicomponent fibers extruded therethrough. For example, orifices 132 may be arranged in a substantially horizontal, rectangular array, typically from 1000 to 5000 per meter of length of the spinneret, with each orifice extruding an individual side-by-side bicomponent fiber. As used herein, the term "spinneret" refers to the lower most portion of the spin pack that delivers the molten polymer to and through orifices for extrusion into the environment. The spinneret can be implemented with holes drilled or etched through a plate or any other structure capable of issuing the required fiber streams.

An array of side-by-side bicomponent fibers 134 exits the spinneret 130 of spin pack 128, and the fibers are quenched as they enter the environment. A drawing force provided by an aspirator 136 (or other suitable drawing mechanism, such as godets) is used to attenuate the extruded fibers. After drawing, the fibers may be processed in any of a variety of manners to form yarn or woven or non-woven fabric.

The polymer components are preferably incompatible or sufficient dissimilar to prevent substantial mixing of the components or chemical reactions between the components. Specifically, when spun together to form a composite fiber, the polymer components preferably exhibit a distinct phase boundary between them so that substantially no blend polymers are formed. The polymer components may comprise any one or combination of melt spinnable resins, including, but not limited to, homopolymer, copolymers, terpolymers and blends thereof of: polyolefins, polyamides, polyesters, polyactic acid, nylon, poly(trimethylene terephthalate), and elastomeric polymers such as thermoplastic grade polyurethane. Suitable polyolefins include without limitation polymers such as polyethylene (e.g., polyethylene terephthalate, low density polyethylene, high density polyethylene, linear low density polyethylene), polypropylene (isotactic polypropylene, syndiotactic polypropylene, and blends of isotactic polypropylene and atactic polypropylene), poly-1-butene, poly-1-pentene, poly-1-hexene, poly-1-octene, polybutadiene, poly-1,7,-octadiene, and poly-1,4,-hexadiene, and the like, as well as copolymers, terpolymers and mixtures of thereof. Further, the components may include additives such as dyes and/or pigments. For example, one component may include one pigment while the other component may include another pigment of a different color.

FIGS. 5 and 6 illustrate a spinneret hole of a spinneret 140 configured to produce a side-by-side bicomponent fiber in accordance with an exemplary embodiment of the present invention. It will be understood that the spinneret includes an array of such spinneret holes to simultaneously produce an array of side-by-side fibers. Spinneret 140 includes channels 142 and 144 which respectively direct streams of molten polymers A and B to the upstream end of a counterbore 146 that tapers at its downstream end to a spinneret hole 148 forming an orifice 150 at the bottom face of spinneret 140. The term "spinneret hole" describes the final capillary-like passage leading to the bottom face of the spinneret through which the side-by-side polymer components flow just prior to being extruded into the environment. Polymers A and B flow side-by-side through counterbore 146, into the spinneret hole 148 and through orifice 150 into the environment.

As shown in FIG. 6, the spinneret hole 148 has a triangular cross-sectional shape transverse to the flow direction. Within the triangular cross-section of the spinneret hole, the lower viscosity polymer component occupies a trapezoidal cross-sectional flow area at the triangle base, bounded by two of the comers of the spinneret hole, while the higher viscosity component occupies a triangular cross-sectional flow area bounded by only one of the comers of the spinneret hole. In this exemplary configuration, the cross-sectional area (A) of the spinneret hole occupied by the higher viscosity component is the same as the cross-sectional area occupied by the lower viscosity component; however, the portion of the perimeter of the spinneret hole bounding the trapezoidal-shaped lower viscosity component is greater in length than the portion of the perimeter of the spinneret hole bounding the triangular-shaped higher viscosity component. By way of non-limiting example, the area A occupied by each of the components can be 0.186 $mm^2$, with the perimeter of the lower viscosity component being 2.33 mm and the perimeter of the higher viscosity component being 1.97 mm. It has been discovered and experimentally verified by the present inventors that by increasing the perimeter of the lower viscosity component, e.g., by employing an arrangement such as that shown in FIG. 6, bending of the bicomponent extrudate can be substantially reduced or eliminated.

The theory supporting the principle of the present invention can be understood from the following expression, the derivation of which is presented hereinbelow:

$$P_H^2=P_L^2\times(V_L/V_H)\times(F_H^2/F_L^2) \quad (1)$$

where:

P=flow area perimeter

V=polymer viscosity

F=polymer volumetric flow rate $_L$=lower viscosity polymer component $_H$=higher viscosity polymer component.

The expression in equation (1) defines the optimum parameter relationship for minimizing or eliminating dog-legging in the extrudate. Variations from the optimum can be employed with small but acceptable degrees of dog-legging. Thus, as used herein and in the claims in connection with the relationship expressed in equation (1), "substantially equal" or "substantially maintaining the equality" means that any inequality in the relationship expressed in equation (1) is sufficiently small to avoid the degree of extrudate bending or dog-legging that makes the fibers un-spinnable in practice (e.g., contact of the extrudate with the spinneret face, clogging of the spinneret, clumping of the extrudate, contact between adjacent extrudate just below the spinneret, etc.).

An explanation of this expression is as follows. In a round spin hole, the lower viscosity polymer component traverses the spinneret hole faster than the higher viscosity polymer component, since the pressure drop through the spinneret hole is the same for both polymer components. Dog-legging or bending of the extrudate occurs at the spinneret hole exit because the faster, lower viscosity stream pushes toward the slower, higher viscosity stream causing a dog-leg bend or deflection toward the higher viscosity side. This phenomenon is analogous to a bi-metal strip bending toward the metal component having the lower coefficient of expansion upon heating.

The present invention comprises a spinneret hole cross-sectional configuration that provides more wetted perimeter to the lower viscosity polymer flow region to create enough excess pressure drop to compensate for the reduced viscosity. The greater the difference in the viscosities of the two side-by-side polymer components, the greater the difference in wetted perimeter required. The expression of equation (1) allows for differences in flow rates of the two polymer components. The same polymer combination may require different hole shapes for greatly different flow rates.

The expression of equation (1) is derived as follows:

Variables:

S=speed of the polymer

P=flow area perimeter

V=polymer viscosity

F=polymer volumetric flow rate

L=spinneret hole length

A=cross section area of the flow path $H_d$=hydraulic diameter of the flow path $_L$=lower viscosity polymer component $_H$=higher viscosity polymer component The formula for the pressure drop through a spin hole is:

$$V\times F\times L/(A\times H_d^2) \quad (2)$$

The pressure drop across the spinneret hole is the same for both components; therefore:

$$V_L\times F_L\times L_L/(A_L\times H_{dL}^2)=V_H\times F_H\times L_H/(A_H\times H_{dH}^2); \quad (3)$$

$$L_L=L_H; \text{ and} \quad (4)$$

$$H_d=4\times A/P. \quad (5)$$

Accordingly, $$V_L\times F_L/(A_L\times(16\times A_L^2/P_L^2))\times V_H\times F_H/(A_H\times(16\times A_H^2/P_H^2)), \quad (6)$$

which simplifies to:

$$V_L\times F_L\times P_L^2/A_L^3=V_H\times F_H\times P_H^2/A_H^3 \quad (7)$$

Since the polymer velocities must be equal to avoid bending of the extrudate, and the velocity, S, is equal to F/A:

$$F_L/A_L=F_H/A_H \quad (8)$$

Equation (7) therefore simplifies to:

$$V_L\times P_L^2/A_L^2=V_H\times P_H^2/A_H^2 \quad (9)$$

Arranging terms in equation (8) yields:

$$A_L=A_H\times F_L/F_H, \quad (10)$$

and substituting $A_L$ in equation (9) yields:

$$V_L\times P_L^2/(A_H\times F_L/F_H)^2=V_H\times P_H^2/A_H^2 \quad (11)$$

Canceling $A_H^2$ from both sides of the equation yields:

$$V_L\times P_L^2\times F_H^2/F_L^2=V_H\times P_H^2. \quad (12)$$

Solving for $P_H^2$ yields the expression of equation (1), namely:

$$P_H^2=P_L^2\times(V_L/V_H)\times(F_H^2/F_L^2) \quad (1)$$

Thus, to equalize the speeds of the higher and lower viscosity polymer components and thereby prevent bending of the bicomponent extrudate, the ratio of the square of the perimeter for the flow area of the higher viscosity component to the square of the perimeter for the flow area of the lower viscosity component must be substantially equal to the ratio of the viscosity of the lower viscosity component to the viscosity of the higher viscosity component multiplied by the ratio of the square of the volumetric flow rate of the higher viscosity component to the volumetric flow rate of the lower viscosity component. Stated in somewhat different terms, from equation (9) it can be seen that the ratio of the perimeter to cross-sectional area of the low viscosity component must be greater than the ratio of the perimeter to cross-sectional area of the high viscosity component in order to eliminate bending of the extrudate.

As used herein, the term "spinneret hole perimeter" or simply "perimeter" refers to the closed curve bounding the transverse cross-sectional area of the spinneret hole. The perimeters of the lower viscosity component and higher viscosity component refer to portions of the spinneret hole perimeter contacting the respective components. Note that the perimeters of the lower and higher viscosity components do not include the boundary between the components themselves, since it is the interaction of the polymer flows with the spinneret hole side walls that affects the flow velocity and extrudate bending.

Taking the special case where the cross-sectional flow path areas of the higher and lower viscosity components are equal (making the volumetric flow rates the same when the component speeds are the same), it can be seen from equation (1) that the square of the perimeter for the flow area of the higher viscosity component must be substantially equal to the product of: the square of the perimeter for the flow area of the lower viscosity component; and the ratio of the viscosity of the lower viscosity component to the viscosity of the higher viscosity component. In simplified terms, for a side-by-side streams of equal amounts of lower and higher viscosity components, bending of the extruded components can be prevented by making the perimeter of the lower viscosity component greater than the perimeter of the higher viscosity component.

Conversely, to see that the lower viscosity polymer component will flow through the spinneret hole faster than the higher viscosity component when the perimeter of the lower viscosity component is not increased, consider the case where the ratios of the perimeter to flow area of the two components are the same ($P_L/A_L=P_H/A_H$). Equation (7) then simplifies to:

$$V_L \times F_L/A_L = V_H \times F_H/A_H \tag{13}$$

The polymer speed is equal to the volumetric flow rate divided by the cross-sectional flow area (S=F/A). Substituting this expression into equation (13) yields $$V_L \times S_L = V_H \times S_H \text{ or } S_L/S_H = V_H/V_L \tag{14}$$

By definition, $V_L<V_H$, so $S_H$ (the speed of the higher viscosity component) must necessarily be less than SL (the speed of the lower viscosity component) to maintain the equality in equation (14). Thus, when two polymers of different viscosities are extruded side-by-side with the equal cross-sectional areas and contacting equal amounts of the spin hole perimeter, the lower viscosity polymer will flow faster than the higher viscosity polymer, resulting in some degree of bending.

Referring again to FIG. 6, although the cross-sectional areas occupied by the higher and lower viscosity components are the same within the spinneret hole, the triangular-trapezoidal arrangement of the two components results in a greater perimeter for the lower viscosity component PL than for the higher viscosity component $P_H$. When the polymer component speeds are equal, so too are the flow rates (i.e., in this case of equal areas); thus, it can be seen from equation (1) that bending of the side-by-side extruded streams is prevented when the relationship of the perimeters PL and PH compensate for difference in the polymer viscosities in accordance with the relationship:

$$P_H^2/P_L^2 = V_L/V_H \tag{15}$$

In the example shown in FIG. 6, the flow cross-sectional areas A for the two polymer components are the same, while the perimeters P are different. However, the areas need not be equal, depending on the polymers and desired characteristics of the extruded fibers. In general, the ratio (and hence cross-sectional area occupied) of the two components can vary. Preferably the weight ratio is in the range of about 10:90 to 90:10, more preferably from about 20:80 to about 80:20, and most preferably from about 35:65 to about 65:35. Likewise, the particular perimeter values described depend on the desired product and polymers employed.

Bending of the extruded side-by-side streams is eliminated when the two polymer flow speeds are the same. Taking into consideration the relationship S=F/A (polymer flow speed=volumetric flow rate/cross-section flow area in the spinneret hole), under equal speed conditions, when the cross-section areas of the spinneret occupied by the two polymer components differ, the flow rates of the components differ proportionally. It can be seen from equation (1) that differing flow rates of the two components impact the perimeter differential required to compensate for a particular viscosity difference.

In cases where the selected perimeters of the polymer components do not entirely compensate for the viscosity difference between the polymer components (i.e., the relationship expressed in equation (1) is substantially equal but not exactly equal), the residual deflection or dogleg bending of the extrudate can be compensated for or eliminated by orienting the flow of the quench air below the spinneret in the direction opposite of the bending. That is, the quench air flows in the direction from the high viscosity component toward the low viscosity component, substantially perpendicular to the boundary between the two components. This air flow can counteract a limited degree of bending by urging the extrudate in the direction opposite the direction in which the extrudate tends to deflect as a result of the viscosity difference.

In general, the perimeter differential required to compensate for viscosity differences can be achieved by distributing the higher viscosity component to a portion of the spinneret hole cross-sectional area shaped to have high perimeter-to-enclosed-area ratio than that occupied by the lower viscosity component. As is well-known, a circle encloses a maximum area for a given perimeter, whereas an elongated, slot-shaped or jagged curve encloses a relatively small area for a given perimeter. By locating the higher viscosity component in a more rounded or bulbous area of the spinneret hole and by locating the lower viscosity component in a more elongated or jagged area of the spinneret hole, one can achieve a wide range of perimeter differentials corresponding to a wide range of viscosity differences that prevent extrudate dogleg. As can be seen in FIG. 6, the trapezoidal cross-sectional area occupied by the lower viscosity component is significantly more elongated than the triangular cross-sectional area occupied by the higher viscosity component, providing the necessary perimeter differential.

A number of other cross-sectional configurations provide significant perimeter differentials. Referring to FIG. 7, a trilobal spinneret hole cross-sectional configuration in accordance with another embodiment of the present invention is shown. The higher viscosity component occupies an entire lobe plus a small portion of each of the other two lobes, with the lower viscosity component occupying the distal portions of the other two lobes. By way of non-limiting example, the cross-sectional areas of the higher and lower viscosity components can be the same (e.g., 0.16 $mm^2$), with the perimeters of the higher and lower viscosity components respectively being 2.04 mm and 2.60 mm, respectively. Again, the particular perimeter and area values provided are specific to a particular embodiment and not intended to be limiting on the scope of the invention.

According to another embodiment of the present invention shown in FIG. 8, the spinneret hole is teardrop-shaped in transverse cross-section, with the lower viscosity component occupying the narrower end and extending more than half way into the wider, more rounded end occupied by the higher viscosity component. By way of non-limiting example, the cross-sectional areas of the higher and lower viscosity components can again be the same (e.g., 0.22 $mm^2$), with the perimeters of the higher and lower viscosity components respectively being 1.83 mm and 2.02 mm, respectively.

The configuration illustrated in FIG. 9, in accordance with another embodiment of the present invention, is generally U-shaped with the spinneret hole sidewall corresponding to the top of the "U" taking on a jagged shape to increase the perimeter in that region. The lower viscosity component occupies the region bounded by the jagged wall, while the higher viscosity component occupies the area bounded by the smooth, rounded wall. Upon extrusion, quenching and drawing, the configuration shown in this embodiment typically produces round fiber.

The spinneret hole of the embodiment illustrated in FIG. 10 has a cross-sectional shape resembling a mercury thermometer with one bulbous end and an opposite end in the form of an elongated stem. The stem end provides a large perimeter and would typically contain the lower viscosity component, with the higher viscosity component occupying the bulbous end.

This embodiment is useful for polymer components having vastly different viscosities, thereby requiring significantly different perimeters for the flow regions containing the respective polymer components.

From the foregoing examples, it can be seen that the present invention encompasses spinneret hole configurations that are asymmetric with respect to the boundary between the two polymer components. For example, the triangular-shaped spinneret hole cross-section shown in FIG. 6 would be symmetric with respect to a polymer boundary line extending from one point of the triangle to the center of the opposite side; however, the triangular shape is asymmetric with respect to the boundary line shown in FIG. 6 that is parallel to one of the sides of the triangle (i.e., the boundary plane within the spinneret hole is parallel to one of the walls of spinneret hole). Similarly the trilobal spinneret hole cross-sectional shape is asymmetric with respect to the polymer boundary curve shown in FIG. 7. Likewise, with each of the spinneret hole transverse cross-sectional shapes shown in FIGS. 8–10, the polymer components are arranged such that the spinneret hole shape is asymmetric with respect to the orientation of the boundary between the two components.

As those skilled in the art will appreciate, the relationship expressed in equation (1) is satisfied by a round spinneret hole extruding a round, side-by-side bicomponent fiber in which the lower viscosity component is in the shape of a crescent. Such a fiber can be produced by appropriately controlling the flow of the two components into the spinneret hole or by employing a very long spinneret hole in which the two components will naturally take on this cross-sectional arrangement. However, such a fiber would have limited commercial value, since it would exhibit poor crimpability relative to non-round side-by-side fibers or conventional round fibers with symmetrically arranged segments. Moreover, while such a fiber could include a low melting point component useful as an adhesive for bonding fibers into a web, it would be more economical to produce a sheath-core fiber for this purpose.

Depending on spinning, quenching and drawing conditions, the side-by-side fibers formed from the process and apparatus of the present invention will, to some degree, maintain the shape of the spinneret hole. For example, the triangular, trilobal, tear-shaped and stem-and-bulb spinneret holes will produce fibers with corresponding shapes. Thus, like the cross-sectional arrangement of the stream of polymer within the spinneret hole, the transverse cross-sectional distribution of the polymers in the resultant fibers will obey the basic relationship that the ratio of the transverse cross-sectional perimeter to area of the component extruded with the lower viscosity (i.e., the viscosity within the spinneret hole at the spinning temperature) is greater than the ratio of the transverse cross-sectional perimeter to area of the component extruded with the higher viscosity. Furthermore, because the cross-sectional perimeter of the fiber is proportional to the outer surface area of the fiber for a given length of fiber, it follows that the ratio of the outer surface area to transverse cross-sectional area of the component extruded with the lower viscosity is greater than the ratio of the outer surface area to transverse cross-sectional area of the component extruded with the higher viscosity.

The specific embodiments illustrated and described herein are intended to be exemplary and not limiting on the scope of the invention. Again, the present invention encompasses any spinneret hole cross-sectional shape and arrangement of polymer components therein that yield a perimeter differential between the higher and lower viscosity components sufficient to limit bending of the extrudate and permit successful extrusion by adequately compensating for the viscosity differential of the components.

The prevent invention vastly expands the number of combinations of commercially available polymers that can be melt-spun into side-by-side bicomponent fibers by allowing polymers having significantly different viscosities, that were heretofore un-spinnable, to be co-extruded without excessive dog-legging. In particular, combinations of polymers known to yield highly crimped bicomponent fibers can now be produced despite substantially viscosity differences between the components. These crimped fibers are useful in any product where properties such as softness, strength, filtration or fluid barrier properties, and high coverage at a low fabric weight are desirable or advantageous. For example, the fibers produced by the methods and apparatus of the present invention can be used in a variety of commercial products including, but not limited to: softer diaper liners, sanitary napkins, disposable wipes or other disposable absorbent articles; medical fabrics having barrier properties such as surgical gowns and drapes and sterilization wraps; filtration media and devices; and liners for articles of clothing (e.g., a liner of a jacket).

The present invention is not limited to the particular apparatus and processes described above, and additional or modified processing techniques are considered to be within the scope of the invention. For example, any number or combination of fiber processing techniques, yam forming techniques, and woven and non-woven fabric formation processes can be applied to the side-by-side fibers formed in accordance with the present invention.

Having described preferred embodiments of new and improved spinneret hole configuration for preventing bending of bicomponent extrudate, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A melt spun side-by-side bicomponent fiber, comprising:

a first component having a first viscosity at a melt-spinning temperature; and a second component arranged side-by-side with the first component and having a second viscosity higher than the first viscosity at the melt-spinning temperature;

wherein a transverse cross-section of the fiber includes an area of the first component and an area of the second component, a perimeter of the transverse cross-section comprising a perimeter of the first component and a perimeter of the second component, and wherein the ratio of the perimeter of the first component to the area of the first component is greater than the ratio of the perimeter of the second component to the area of the second component.

2. The fiber of claim 1, wherein at least one of said first and second components is crimped.

3. The fiber of claim 1, wherein said fiber has a non-round transverse cross-sectional shape.

4. The fiber of claim 3, wherein said fiber has a substantially triangular transverse cross-sectional shape.

5. The fiber of claim 3, wherein said fiber has a substantially trilobal transverse cross-sectional shape, including first, second and third lobes.

6. The fiber of claim 3, wherein said fiber has a substantially teardrop transverse cross-sectional shape having a narrow end and a wide end.

7. The fiber of claim 3, wherein the transverse cross-sectional shape of said fiber includes a bulbous portion and an elongated stem portion extending from the bulbous portion.

8. A yarn comprising a plurality of the fibers of claim 1.

9. A fabric comprising a plurality of the fibers of claim 1.

* * * * *